United States Patent [19]

Tranberg

[11] 4,096,719

[45] Jun. 27, 1978

[54] ARRANGEMENT IN DOOR-LOCKS

[75] Inventor: Erik Rudolf Tranberg, Eskilstuna, Sweden

[73] Assignee: GKN-Stenman AB, Eskilstuna, Sweden

[21] Appl. No.: 766,821

[22] Filed: Feb. 8, 1977

[30] Foreign Application Priority Data

| | | |
|---|---|---|
| Feb. 10, 1976 | Sweden | 7601429 |
| Jun. 24, 1976 | Sweden | 7607329 |

[51] Int. Cl.[2] ..... E05B 9/08

[52] U.S. Cl. ..... 70/450; 70/DIG. 43; 292/337

[58] Field of Search ..... 70/450, 443, 448, 447, 70/DIG. 43, DIG. 56, 107, 416, 417; 292/337

[56] References Cited

U.S. PATENT DOCUMENTS

| | | | |
|---|---|---|---|
| 372,962 | 11/1887 | Budd et al. | 70/450 X |
| 503,400 | 8/1893 | Biggs | 70/450 X |
| 973,990 | 10/1910 | Stone | 70/447 X |
| 997,074 | 7/1911 | Matheson | 70/450 |
| 1,518,395 | 12/1924 | Dexter | 70/450 X |
| 2,178,132 | 10/1939 | Anderson | 70/450 |
| 2,357,552 | 9/1944 | Schlase | 70/450 X |
| 2,454,145 | 11/1948 | Erkkila | 70/448 |
| 3,479,851 | 11/1969 | Davidson et al. | 70/450 X |

FOREIGN PATENT DOCUMENTS

| | | | |
|---|---|---|---|
| 284,138 | 1/1928 | United Kingdom | 70/450 |
| 411,077 | 5/1934 | United Kingdom | 70/450 |

*Primary Examiner*—Roy D. Frazier
*Assistant Examiner*—William E. Lyddane
*Attorney, Agent, or Firm*—Sughrue, Rothwell, Mion, Zinn and Macpeak

[57] ABSTRACT

A door-lock is provided with a lock-housing which accommodates a lock mechanism. The lock-housing comprises two connectable parts, of which at least one can be connected to a face plate which is provided with recesses for the dead bolt and latch bolt of the lock. The face plate comprises a U-shaped member which coacts with the end of the lock-housing facing the face plate to stiffen the lock-housing and form a combined unit which presents high resistance to forcing. The face plate and the member form a separate element which is removably connectable to the lock-housing. The lock-housing may either have a recess for receiving the member, said recess engaging around the two lock-housing parts, or, alternatively, the end of the lock-housing facing the face plate may be open; in which case the member enters the lock-housing through said opening and the two lock-housing parts engaging around the member.

6 Claims, 4 Drawing Figures

ARRANGEMENT IN DOOR-LOCKS

The present invention relates to an arrangement in a door-lock provided with a lock-housing accommodating the locking mechanism and comprising two connectable parts, of which parts at least one is connected with a face plate provided with a recess for receiving the dead and latch bolts of the lock.

In lock-housings of this type, the face plate is normally connected to said one lock-housing portion as by welding for example, thereby enabling the housing to be opened so that the lock-housing mechanism can be serviced, without it being necessary to remove the other housing portion from the face plate.

In recent years, it has become more and more necessary to provide lock constructions which have a greater mechanical strength than previously known locks and which are not readily forced open. In breaking or forcing open a lock, the face plate is often forced with a crowbar or a similar tool, causing the face plate to fracture or to loosen from the housing. This enables a door secured by the lock to be readily opened.

Other types of known door-locks for different purposes are described in Finnish Pat. No. 24,832, U.S. Pat. Nos. 867,574 to Egge and 997,074 to Matheson and German Offenlegungsschrift No. 2,262,322.

An object of the present invention is to provide a door-lock which is considerably more resistant to forcing than previously known locks, without being more expensive.

In accordance with the invention there is provided an arrangement in door-locks of the aforementioned type which is characterised in that the face plate presents a member arranged by co-acting with the end of the lock-housing facing the face plate to stiffen the lock-housing and, combined with the lock-housing, to form a unit which presents high resistance to forcing.

Owing to the fact that said element cooperates with the lock-housing in the manner described, the face plate, the element and the lock-housing together form an extremely rigid unit which can take up the large forces to which the lock is subjected when entry is being forced on a door.

The invention is not restricted to any specific type of mortise lock and can be applied irrespective of whether the lock-housing accommodates one lever-tumbler mechanism or dead-bolt, latch-bolt mechanisms or a plurality of such mechanisms.

It is preferred in practise that the face plate and said member form a separate element which can be removeably connected to the lock-housing.

In this way important advantages are gained which permit the rational manufacture of the lock in large series, since it is possible to store the actual lock-housing as a partly assembled unit in a standard design, for example without regard to surface treatment, so that face plates which have been surface treated in the alternative manner often required by the trade can be assembled subsequently to said housing. The lock housing itself can thus, for example, be coated with zinc whilst the face plate, for example, may be coated with nickel or chromium, or may be made of brass or coated with an epoxy resin etcetera.

In one embodiment the lock-housing has a recess for receiving the member, said recess engaging around the two lock-housing parts.

A modified arrangement is characterised in that at least part of the end of the lock-housing facing the face plate is open and that the member enters the lock-housing through said opening, the two lock-housing parts engaging around the member.

When said member enters the lock-housing in the aforedescribed manner, access to said member is more difficult when an attempt is made to force a lock.

The face plate and/or said element may comprise a different material to the lock-housing. This affords the advantage whereby it is unnecessary to subject the whole of the lock-housing to a relatively expensive surface treatment process, but that such treatment can be restricted to the face plate, which is the visible part of the lock when the lock is mounted in the door. Furthermore, as will readily be understood, the face plate of a complete lock-housing can be changed when a face plate of some other design is desired.

It is often preferred that the face plate and said element are made of steel having good mechanical strength properties.

In practise, the element engaging the lock-housing is a U-shaped member. This design is, as a rule, the simplest and least expensive in practise. The U-shaped member is provided with holes for receiving screws for attaching the unit comprising the face plate and the U-shaped member to the lock-housing.

In certain instances, the U-shaped member may be made integrally with the face plate.

Some embodiments of the invention will now be described in more detail with reference to the accompanying drawings.

Corresponding parts have been given the same reference numeral in the different drawing figures.

Figure 1:
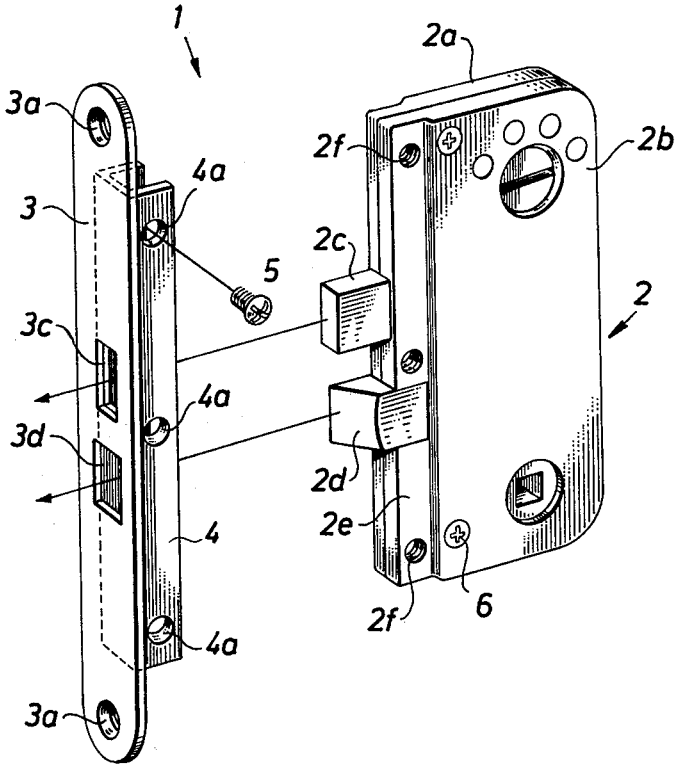
FIG. 1 is a perspective, exploded view of a lock-housing on which a face plate provided with an arrangement according to the invention can be mounted.

The reference 1 indicates a door-lock, the main part of which comprises a lock-housing 2 having two parts **2*a* and 2*b*, said parts being joined together by screws 6. Although not shown, in the lock of the illustrated embodiment the lock-housing accommodates a dead bolt mechanism and a latch bolt mechanism which operate a dead bolt 2*c* and a latch bolt 2*d*** projecting outwardly of the lock-housing.

The door-lock also comprises a face plate or lock post 3 which is provided, in a conventional manner, with holes **3*a* for receiving screws by which the lock can be screwed to the door, and presents recesses 3*c* and 3*d*** for the dead bolt and latch bolt, respectively.

In order to make the lock more difficult to force, the face plate 3 is provided on the side thereof facing the lock-housing with a U-shaped member 4 which, in the assembled position of the face plate, engages around the leading part of the housing. The U-shaped member has holes **4*a* for receiving screws 5** by means of which said member can be secured to the lock-housing. In this way, the face plate and the U-shaped member together with the lock-housing form an extremely rigid unit, which is able to take-up the forces to which the lock is subjected when, for example, a door to which the lock is fitted if forced.

Figure 2:
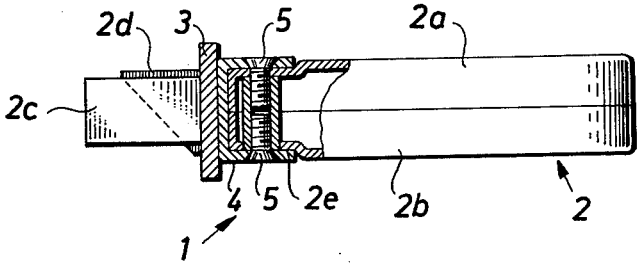
FIG. 2 is a plan view, partly cut away, of the lock-housing shown in FIG. 1 with the face plate and the U-shaped member in their assembled positions.

In the embodiment illustrated in FIGS. 1 and 2 the leading end of the lock-housing is provided with a recess portion *2e* on which the U-shaped member 4 is arranged. The lock-housing and the face plate assembled thereto thus have the same dimensions as the lock of previously known design which has no U-shaped member.

Figure 3:
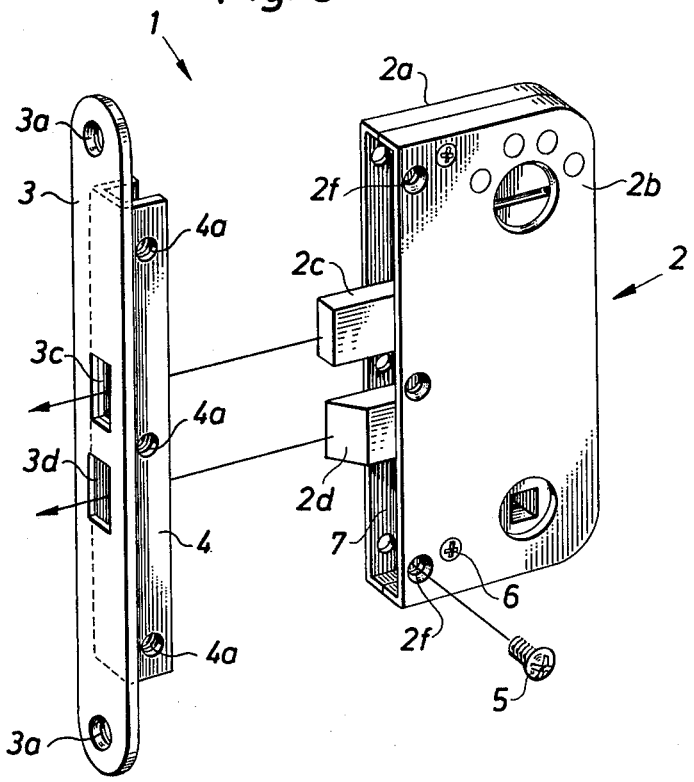
FIG. 3 is a perspective, exploded view showing a modified lock-housing having an open end adapted, in accordance with the invention, to cooperate with a face plate provided with a U-shaped member.
Figure 4:
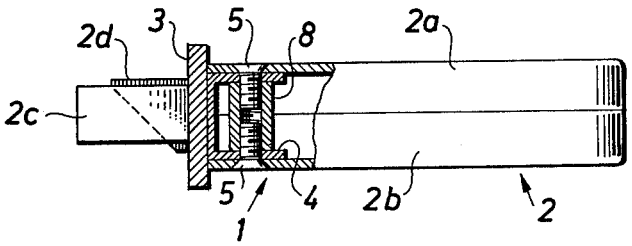
FIG. 4 is a plan view, partly cut away, of the lock-housing shown in FIG. 3, with a face plate and the U-shaped member in the assembled position.

In the modified embodiment illustrated in FIGS. 3 and 4, the end of the lock housing 2 facing the face plate 3 is open. The opening is referenced 7 in FIG. 3. In order to stiffen the lock-housing and to increase the reliability of the lock against forcing, the face plate 3 is provided on the side thereof facing a lock-housing 2 with a U-shaped member 4 which, in the assembled position of the face plate illustrated in FIG. 4, enters the opening 7 so that the portions of the lock-housing parts *2a, 2b* located in the region of the opening engage the legs of the U-shaped member 4. In this way, the lock-housing is stiffened from the inside, and the U-shaped member is practically inaccessable from the outside.

In both embodiments the U-shaped member is provided with holes *4a* for screws 5 by means of which it can be secured to the lock-housing. The face plate and the U-shaped member together with the lock-housing form, in this manner, a particularly rigid unit which is able to take-up the large forces to which the lock is subjected, for example, when the lock is being forced.

The screws 5 passing through holes *2f* co-act with screw-threads in a spacer 8 located between the legs of the U-shaped member. These spacers also serve to stiffen the lock-housing.

The face plate and the U-shaped member may be made of steel and may be joined together as by welding for example. They may also be formed integrally as a one-piece unit.

The lock-housing 2 may be made of zinc-coated steel, while the face plate 3 and the U-shaped member 4 comprise hardened steel having a high mechanical strength and suitably surface treated, depending upon the desired use.

With the dimensions of the latch bolt and the dead bolt kept the same in the second embodiment, the dimensions of the lock-housing are slightly larger than the lock-housing according to FIGS. 1 and 2. This is of little importance, however, when the size of the mortise in the door is not critical.

What I claim is:

1. A door lock assembly, comprising:

a. a hollow, generally rectangular housing member formed by two connected halves and adapted to accommodate therein a latch bolt mechanism and a dead bolt mechanism, including a latch bolt and a dead bolt extending outwardly from one side of the housing member, b. face plate means, comprising:

1. an elongated face plate having apertures therein for receiving the latch bolt and dead bolt, the vertical height of said face plate being greater than the horizontal depth of the housing member, 2. an elongated U-shaped member comprising a bridging portion and a pair of opposite leg portions extending outwardly from the bridging portion, said bridging portion being rigidly joined to the back side of said face plate and said leg portions extending into mating engagement with said one side of the housing member over a substantial portion of the length of said face plate, and c. means removably connecting said leg portions to both halves of the housing member, whereby said U-shaped member stiffens and reinforces said housing member and forms a unitary assembly therewith which presents a high degree of resistance to forcing.

2. A door lock assembly as defined in claim 1, wherein said one side of the housing member has recessed vertical edges adapted to fit within said leg portions.

3. A door lock assembly as defined in claim 1, wherein said one side of the housing member is open, and said leg portions fit within said open side.

4. A door lock assembly according to claim 1, wherein the face plate and the U-shaped member are formed of a material different from that of the housing member.

5. A door lock assembly according to claim 4, wherein the face plate and the U-shaped member are made of hardened steel.

6. A door lock assembly according to claim 1, wherein the U-shaped member is formed integrally with the face plate.

* * * * *